US011647835B2

(12) United States Patent
Williams et al.

(10) Patent No.: US 11,647,835 B2
(45) Date of Patent: May 16, 2023

(54) STORAGE ASSEMBLY

(71) Applicant: Smith System Manufacturing Company, Carrollton, TX (US)

(72) Inventors: David Williams, Ringwood (GB); Roger John Carr, Croydon (GB); Michael Risdall, Minneapolis, MN (US); Robert Scharfenkamp, Prosper, TX (US); Jack Wayne Johnson, McKinney, TX (US); Matthew Dewey, Plano, TX (US)

(73) Assignee: Smith System Manufacturing Company, Carrollton, TX (US)

( * ) Notice: Subject to any disclaimer, the term of this patent is extended or adjusted under 35 U.S.C. 154(b) by 0 days.

(21) Appl. No.: 16/833,739

(22) Filed: Mar. 30, 2020

(65) Prior Publication Data

US 2021/0298471 A1 Sep. 30, 2021

(51) Int. Cl.
*A47B 87/00* (2006.01)
*A47B 47/00* (2006.01)

(52) U.S. Cl.
CPC ..... *A47B 87/008* (2013.01); *A47B 47/0091* (2013.01)

(58) Field of Classification Search
CPC ..... A47B 87/008; A47B 87/0276; A47B 87/0284; A47B 87/0292; A47B 87/0207; A47B 87/005; A47B 87/007; A47B 87/00; A47B 47/0091; A47B 47/047
See application file for complete search history.

(56) References Cited

U.S. PATENT DOCUMENTS 790,440 A * 5/1905 Klein ..... A47F 7/163 211/45
1,412,895 A * 4/1922 Rosenthal ..... A47B 61/00 312/107
1,978,494 A 10/1934 Junkers
(Continued)

FOREIGN PATENT DOCUMENTS

BE 1007253 A3 * 5/1995 ..... A47B 87/00
DE 2201642 A1 * 8/1973 ..... A47B 47/0075
(Continued)

OTHER PUBLICATIONS

ISA/US; International Search Report; dated May 19, 2021; Entire document.

*Primary Examiner* — Stanton L Krycinski
(74) *Attorney, Agent, or Firm* — Price Heneveld LLP

(57) ABSTRACT

A storage assembly includes top and bottom walls, a pair of end walls extending between the top and bottom walls and cooperating with the top and bottom walls to define an interior space, and at least one end surface configured to closely interfit with at least one end surface of an adjacent storage assembly that is substantially similar to the storage assembly at a predefined angular orientation such that a longitudinal axis of the storage assembly is angularly offset from a longitudinal axis of the adjacent storage assembly when the at least one end surface of the storage assembly is interfit with the at least one surface of the adjacent storage assembly The storage assembly may also include a pair of interior walls and a handle relief extending into the top wall and/or a frame assembly located between one of the end walls and one of the interior walls.

22 Claims, 6 Drawing Sheets

(56) References Cited

U.S. PATENT DOCUMENTS 2,496,221 A 1/1950 Koch
2,525,208 A * 10/1950 Clink ..... B25H 1/12 312/107
2,543,263 A * 2/1951 Vanderveld ..... A47B 87/008 312/107
2,721,662 A 10/1955 Miller
2,771,334 A * 11/1956 Ernestt ..... A47B 69/00 312/140.2
2,995,408 A * 8/1961 Kobrin ..... A47B 69/00 312/140.2
3,257,154 A * 6/1966 Lewis ..... A47B 49/00 312/198
3,450,451 A * 6/1969 Lyman, Jr. ..... A47B 57/00 312/198
3,520,583 A * 7/1970 Case ..... A47B 87/00 312/277
3,532,403 A * 10/1970 Koski ..... A47B 69/00 312/140.2
3,931,894 A * 1/1976 Murphy ..... A47F 5/00 211/189
3,961,830 A * 6/1976 Gosswald ..... A47B 87/0276 312/135
4,548,324 A * 10/1985 Mackey, Jr. ..... A47F 5/02 211/129.1
4,702,534 A * 10/1987 Witt ..... G09F 15/0068 312/114
4,786,122 A 11/1988 Nichoalds
5,069,466 A 12/1991 Propst
5,083,512 A * 1/1992 Newhouse ..... A47B 21/06 108/50.02
5,159,973 A * 11/1992 Pennington ..... A47J 39/006 126/400
D331,334 S 12/1992 Hollington
5,405,192 A * 4/1995 McGrath ..... A47B 87/007 312/108
D360,725 S 7/1995 Snell
D361,643 S 8/1995 Snell
D361,681 S 8/1995 Calder
D365,944 S 1/1996 Lechleiter et al.
5,566,961 A 10/1996 Snell et al.
D376,282 S 12/1996 Sandy
5,588,541 A * 12/1996 Goetz ..... A47B 87/008 211/186
5,634,649 A 6/1997 Breining et al.
D382,146 S 8/1997 Sandy
5,702,166 A * 12/1997 Lee ..... E04H 1/14 312/107
D399,377 S 10/1998 Robertson et al.
D405,616 S 2/1999 Hellwig et al.
D409,019 S 5/1999 Crinion
D410,807 S 6/1999 Fear et al.
6,155,435 A * 12/2000 Malik ..... A47B 57/26 108/64
6,202,867 B1 * 3/2001 Di Blasi ..... A47B 47/0075 108/138
6,209,977 B1 4/2001 Vondrejs
D445,984 S 7/2001 Dickinson et al.
6,267,462 B1 * 7/2001 Krause ..... A47B 87/007 312/108
6,341,511 B1 * 1/2002 Snoke ..... E05B 65/462 312/218
D460,877 S 7/2002 Waisbrod et al.
6,443,542 B1 9/2002 Lindquist et al.
6,460,950 B2 10/2002 Spitzer et al.
D472,689 S 4/2003 Benn
6,692,011 B2 2/2004 Carlson et al.
6,776,464 B2 8/2004 Klassen et al.
6,824,231 B2 11/2004 Jakob-Bamberg et al.
D501,285 S 1/2005 Long, Jr.
7,131,544 B1 * 11/2006 Cunningham ..... A47B 73/006 211/74
7,172,094 B2 * 2/2007 Atsuta ..... A47B 87/007 221/130
7,174,851 B2 * 2/2007 Bonner ..... A01K 1/0035 119/416
7,325,891 B1 2/2008 Kinsley et al.
7,354,120 B2 * 4/2008 DeMars ..... A47F 9/00 126/25 R
7,434,819 B1 * 10/2008 Dunavin ..... B25H 3/02 144/285
7,544,915 B2 * 6/2009 Hu ..... B62B 3/006 219/387
7,654,399 B2 * 2/2010 Scholen ..... A47F 5/0846 211/26
7,950,679 B2 * 5/2011 Claffy ..... B62B 3/006 280/47.35
8,123,311 B2 * 2/2012 Nilsson ..... A47B 47/0083 312/108
8,157,337 B2 * 4/2012 Manalang ..... B25H 3/06 312/249.8
D661,512 S 6/2012 McRorie
8,322,732 B2 12/2012 McKay et al.
8,419,140 B2 * 4/2013 Ward ..... A47F 7/283 312/7.2
8,684,552 B2 * 4/2014 de Blois ..... A47B 13/023 362/133
8,708,168 B2 * 4/2014 Lin ..... A47B 87/0207 211/131.1
D726,987 S 4/2015 Ruiz et al.
9,079,596 B2 7/2015 Sofy et al.
9,084,480 B2 * 7/2015 Atwood ..... A47B 47/042
9,456,688 B2 * 10/2016 Moyer ..... A47B 47/0091
9,730,517 B2 8/2017 Youngs et al.
9,936,806 B2 * 4/2018 Taylor, Jr. ..... A47B 67/00
10,174,515 B1 * 1/2019 Krivens ..... A47B 83/02
10,178,908 B1 * 1/2019 Tseng ..... A47B 47/0091
2003/0173877 A1 * 9/2003 Pleiman ..... A47B 81/002 312/238
2004/0119382 A1 * 6/2004 Dettmann ..... A47B 19/00 312/198
2005/0051108 A1 * 3/2005 Syrigos ..... A01K 1/035 119/416
2005/0140106 A1 6/2005 Huguet
2007/0152546 A1 * 7/2007 Sallinger ..... A47B 83/001 312/198
2007/0252489 A1 * 11/2007 Schulz ..... A47B 87/007 312/7.2
2008/0237322 A1 10/2008 Mettelstaedt
2010/0245999 A1 9/2010 Carlow et al.
2011/0068562 A1 3/2011 Keffeler et al.
2013/0186844 A1 * 7/2013 Lupo ..... A47B 87/008 211/42
2014/0166516 A1 6/2014 Martinez et al.
2015/0285531 A1 10/2015 Lee et al.
2015/0320207 A1 * 11/2015 Chan ..... A47B 87/0276 312/108
2016/0143456 A1 * 5/2016 Sirotovsky ..... A47F 5/16 705/39
2016/0262842 A1 * 9/2016 Sellers ..... A47B 47/0091
2018/0334270 A1 11/2018 Nash et al.

FOREIGN PATENT DOCUMENTS

DE 3225757 A1 * 1/1984 ..... A47B 87/0276
DE 3241717 A1 * 5/1984 ..... A47F 5/0018
DE 9403450 U1 * 6/1994 ..... A47B 87/007
DE 9408570 U1 * 9/1994 ..... A47F 3/005
DE 4319228 A1 * 12/1994 ..... A47B 87/007
DE 29617605 U1 * 2/1997 ..... A47B 87/007
DE 29801612 U1 * 3/1998 ..... A47F 3/007
DE 29917874 U1 * 12/1999 ..... A47B 87/008
DE 102004037138 A1 * 3/2006 ..... A47B 83/00
EP 0744141 A2 * 11/1996 ..... A47B 87/008
EP 0947150 A1 10/1999
EP 3400830 B1 * 12/2019 ..... A47B 87/00
FR 2063353 A5 * 7/1971 ..... A47B 87/0276
FR 2639527 A1 * 6/1990 ..... A47F 11/00
FR 2734998 A1 * 12/1996 ..... A47B 87/00
FR 2906447 A1 * 4/2008 ..... A47F 9/00
FR 3054420 2/2018

(56) References Cited

FOREIGN PATENT DOCUMENTS

| | | | | | |
|---|---|---|---|---|---|
| GB | 619191 | A * | 3/1949 | ..... | A47B 87/00 |
| JP | 02220609 | A | 9/1990 | | |
| JP | 2017086432 | A | 5/2017 | | |
| WO | WO-9415505 | A1 * | 7/1994 | ..... | A47B 87/007 |

* cited by examiner

STORAGE ASSEMBLY

BACKGROUND OF THE INVENTION

A storage assembly configured to closely interfit with adjacent storage assemblies in a linearly offset, end-to-end relationship such that the storage assemblies cooperate to provide a storage arrangement configured to subdivide a given floor workspace area.

SUMMARY OF THE INVENTION

The storage assembly as described herein may include a top wall, a bottom wall, a pair of end walls extending between the top and bottom walls and cooperating with the top and bottom walls to define an interior space, and at least one end surface configured to closely interfit with at least one end surface of an adjacent storage assembly that is substantially similar to the storage assembly at a predefined angular orientation such that a longitudinal axis of the storage assembly is angularly offset from a longitudinal axis of the adjacent storage assembly when the at least one end surface of the storage assembly is interfit with the at least one surface of the adjacent storage assembly.

The storage assembly may additionally or alternatively include a top wall, a bottom wall spaced from the top wall, a pair of interior end walls extending between the top and bottom walls and cooperating with the top and bottom walls to define an interior storage space, a pair of exterior end walls extending between the top and bottom walls and spaced outward of the interior end walls, and a handle relief extending into the top wall at a position between one of the interior end walls and one of the exterior end walls and configured for grasping by a user to move the storage assembly.

The storage assembly may also alternatively or additionally include a top wall, a bottom wall spaced from the top wall, a pair of interior end walls extending between the top and bottom walls and cooperating with the top and bottom walls to define an interior storage space, an exterior wall extending between the top and bottom walls and positioned outside of the internal storage space, wherein the top wall, one of the interior walls and the exterior wall cooperate to define an open area, and a frame assembly located within the open area and extending between the top and bottom walls.

The storage assembly and related storage arrangements as shown and described herein are configured to advantageously subdivide a given floor workspace area to maximize the use thereof without the use of separate partition or wall assemblies, provide a clean aesthetic look when engaged with one another while simultaneously minimizing the required floor area. The storage assemblies are highly mobile thereby allowing easy movement and reconfiguration of each storage assembly and overall storage arrangement, and provide a highly reconfigurable storage arrangement allowing a user to optimize the use of the associated storage area.

These and other advantages of the storage assembly as shown and described herein will be further understood and appreciated by those skilled in the art by reference to the following specification, claims, and appended drawings.

DETAILED DESCRIPTION OF THE PREFERRED EMBODIMENTS

Figure 3:
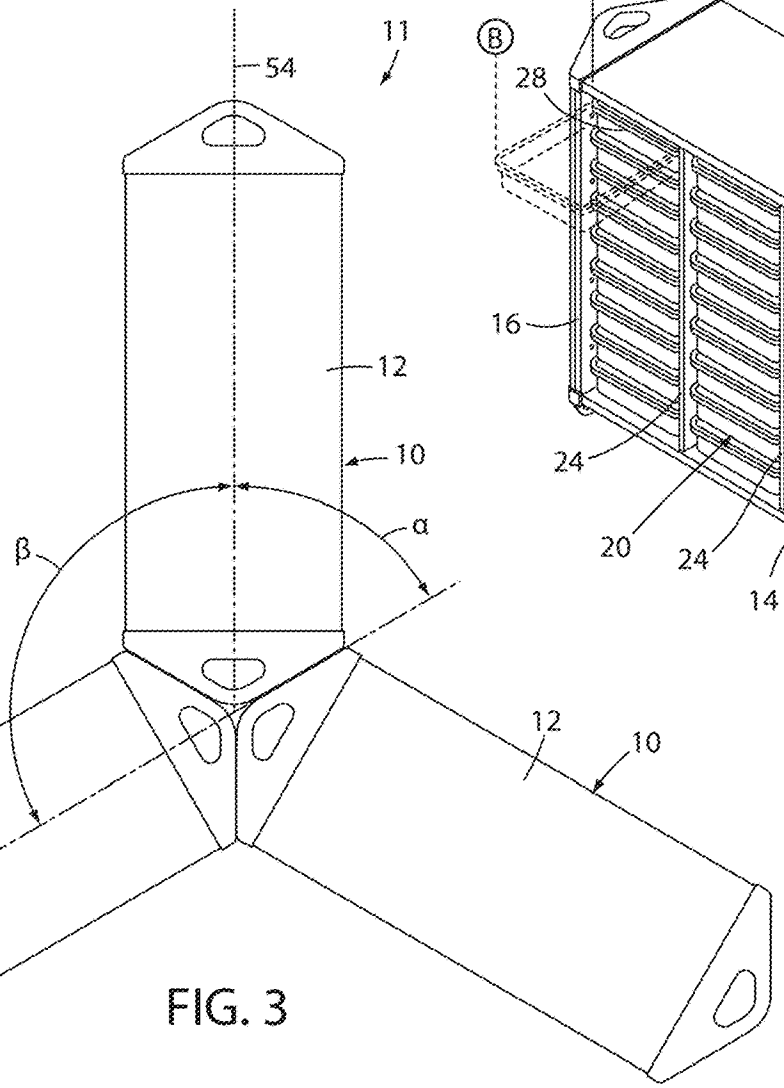
FIG. 3 is a top plan view of multiple storage assemblies closely interfit with one another in an end-to-end, non-linear orientation, and cooperating to provide a storage arrangement.
Figure 1:
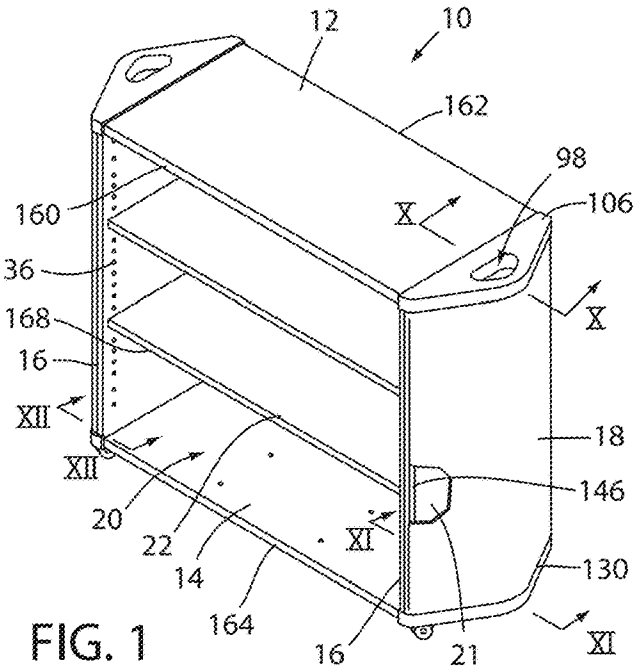
FIG. 1 is a perspective view of a storage assembly that includes a plurality of shelves subdividing an interior storage space of the storage assembly.

For purposes of description herein, the terms "upper," "lower," "right," "left," "rear," "front," "vertical," "horizontal," and derivatives thereof shall relate to the invention as oriented in FIGS. 1 and 3. However, it is to be understood that the invention may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other characteristics relating to the embodiments disclosed herein are not to be considered as limiting, unless the claims expressly state otherwise.

The reference numeral 10 generally designates a storage assembly that may be provided in various configurations (FIGS. 1, 2, 4 and 5) each configured to closely interfit with adjacent storage assemblies in a linearly offset or non-linear, end-to-end relationship (FIGS. 3 and 6), such that a plurality of the storage assemblies 10 cooperate to provide a storage arrangement 11 configured to subdivide a given floor workspace area.

In the illustrated example, the storage assembly 10 may include a top wall 12, a bottom wall 14 spaced vertically below the top wall 12, a pair of internal side walls 16 extending vertically between the top wall 12 and the bottom wall 14, and a pair of external side walls 18 located outwardly from the internal side walls 16 along the length of the storage assembly 10. The top wall 12, the bottom wall 14 and the internal side walls 16 may cooperate to define an internal storage space 20 that may be subdivided by various internal components to meet a particular user's requirements, while the internal side walls 16 cooperate with the external side walls 18 to define open spaces 21 therebetween. In the illustrated examples, the storage assembly 10 (FIGS. 1, 2, 4 and 5) may include one or more horizontal shelves 22 extending an entire distance between the internal side walls 16 (FIG. 1), one or more vertical partitions 24 (FIGS. 2, 4 and 5) extending between the top wall 12 and the bottom wall 14 and spaced between the internal side walls 16, horizontal shelves 26 (FIGS. 4 and 5) extending between one of the internal side walls 16 and a vertical partition 24 and/or between a pair of the vertical partitions 24, one or more drawers 28 (FIGS. 2 and 5) movable between a retracted position A where the door 28 is received within the interior space 20 and an extended position B where the drawer 28 extends from within the interior storage space 20, and/or any combination thereof.

The storage assembly 10 may also include a rear wall 30 that may be secured to the top wall 12, the bottom wall 14 and/or the interior side walls 16. The storage assembly 10 may also be constructed without the rear wall 30 thereby allowing access to the interior storage space 20 from both sides of the storage assembly 10. One or more shelf support brackets 34 (FIGS. 7 and 8) may support the shelves 22, 26 at various, pre-selected vertical positions within the interior storage space 20. In the illustrated example, the shelf support brackets 34 are configured to engage one or more vertical rows of spaced apertures 36. Each support bracket 34 may include a vertical portion 35, a horizontal shelf-supporting portion 37, and an outwardly-positioned guide portion 39 configured to abut an edge of the shelf 22 and keep the shelf 22 centered between cooperating support brackets 34. It is also noted that the configuration of the support brackets 34 that include the guide portion 39 allow the associated shelves 22, 26 to be supported in an angular or tilted orientation within the interior storage space 20 with the support brackets 34 located at the front of the storage assembly 10 being positioned lower than the support brackets located at the rear of the storage assembly 10.

The top wall 12, the bottom wall 14, the internal side walls 16, the shelves 22, 26, and the rear wall 30 may comprise metal, wood, plastic or various combinations thereof. In the illustrated example, the top wall 12, the bottom wall 14, the internal side walls 16, the shelves 22, 26 and the rear wall 30 comprise wood or laminated wood, while the external side walls 18 comprise plastic and may include a layered configuration as discussed below.

The top wall 12 (FIGS. 1 and 7) may include a central portion 38 vertically aligned with the interior storage space 20, and a pair of opposite end portions 40 extending outward from the central portion 38 beyond the internal side walls 16. Similarly, the bottom wall 14 may include a central portion 42 vertically aligned with the interior storage space 20, and a pair of opposite end portions 44 extending outward from the central portion 42 beyond the interior side walls 16. Alternatively, the top wall 12 and the bottom wall 14 may include a single end portion 40, 44, respectively. Each end portion 40 of the top wall 12 may include an end surface 46, while each end portion 44 of the bottom wall 14 may include an end surface 48. In the illustrated example, the end surface 46 of each end portion 40 of the top wall 12 includes a pair of substantially straight edge portions 50, while the end surface 48 of each end portion 44 of the bottom wall 14 includes a pair of substantially straight edge portions 52. Preferably, each straight edge portion 50, 52 extends at an angle $\alpha$ (FIG. 3) of less than 90° from a centerline or longitudinal axis 54 of the storage assembly 10. More preferably, each straight edge portion 50, 52 extends at an angle of less than or equal to about 60° from the longitudinal axis 54.

Figure 7:
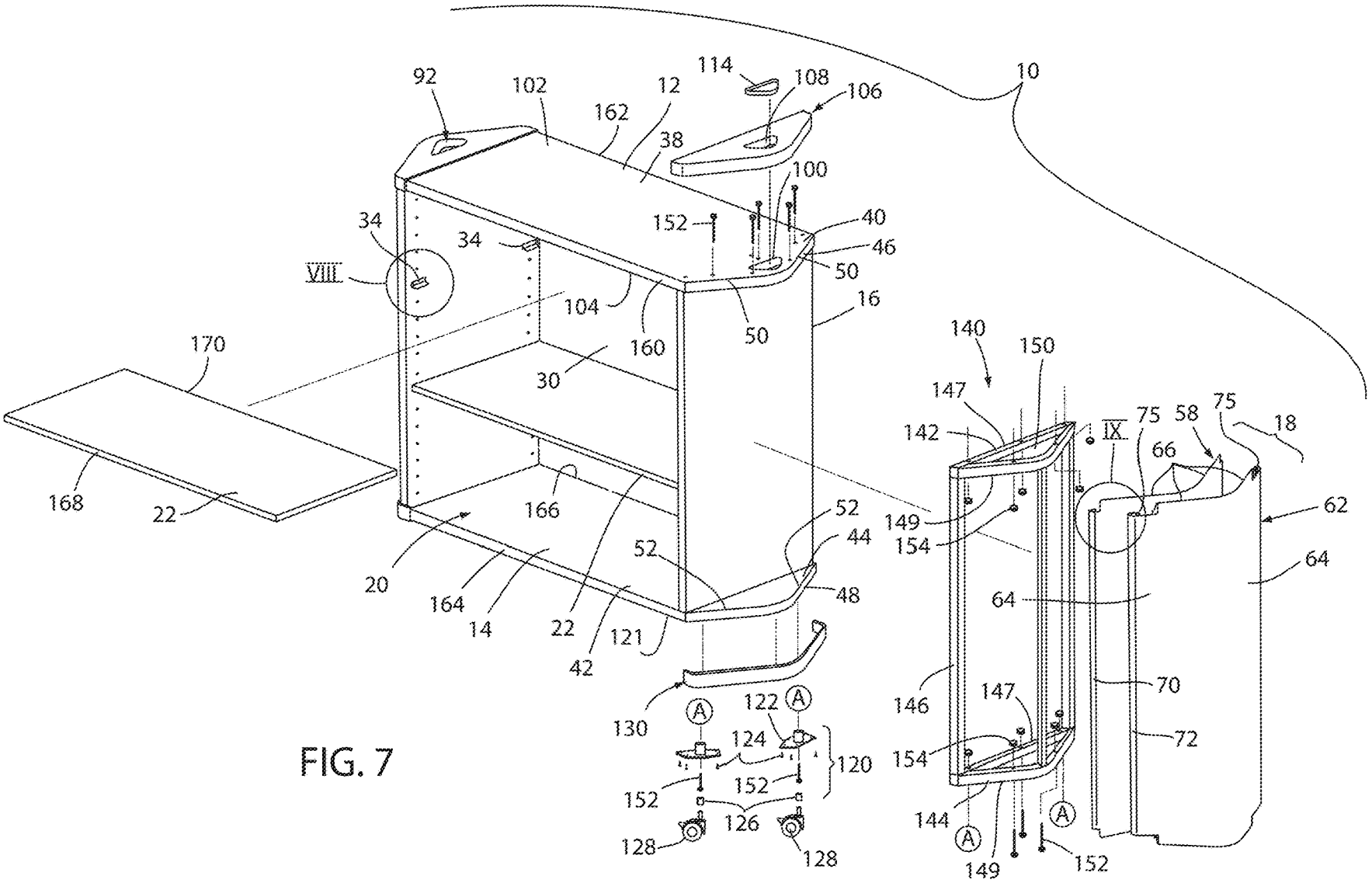
FIG. 7 is an exploded perspective view of the storage assembly as shown in FIG. 1.
Figure 8:
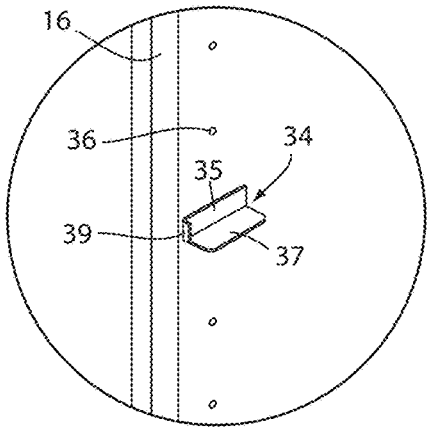
FIG. 8 is an enlarged view of the area VIII, FIG. 7.
Figure 9A:
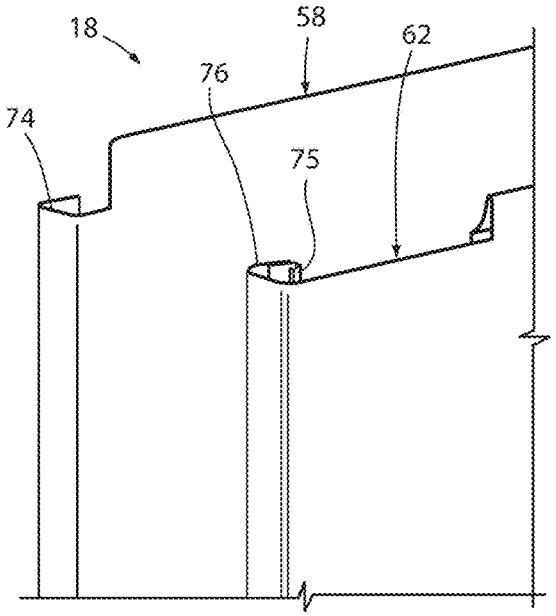
FIG. 9A is an enlarged view of the area IX, FIG. 7.
Figure 9B:
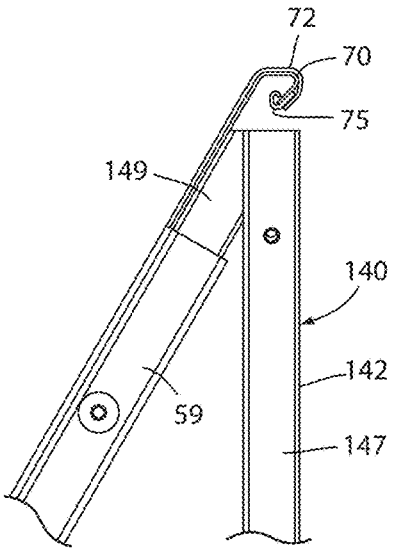
FIG. 9B is an enlarged, partial plan view of an external wall and a frame assembly.
Figure 9C:
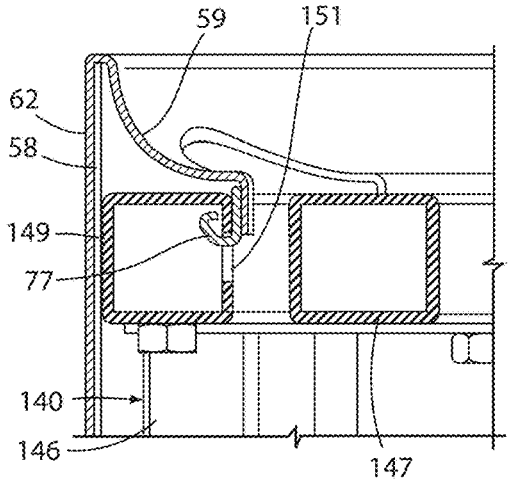
FIG. 9C is an enlarged, partial, cross-sectional elevational view of the external wall and the frame assembly.
Figure 9D:
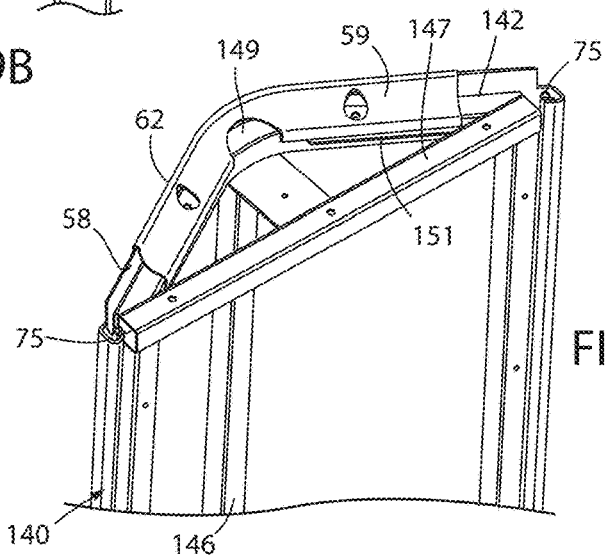
FIG. 9D is an enlarged, partial perspective view of the external wall and the frame assembly.

As best illustrated in FIG. 7, each external side wall 18 may include a plurality of layered components such as an internal structural reinforcement member 58 and an aesthetic external cover member 62. In the illustrated example, each external side wall 18 includes a pair of end surfaces 64 each including a pair of substantially straight portions 66 each extending from the longitudinal axis 54 of the storage assembly 10 at a similar angle to that as discussed above with respect to the straight edge portions 50, 52 of the top and bottom walls 12, 14. The vertical outer edges 70 (FIGS. 7 and 9A) of the internal structural reinforcement member 58 and/or the vertical outer edges 72 of the external cover member 62 may include a curved or structural reinforcement edge 74, 76, respectively, to structurally reinforce the external side wall 18. As best illustrated in FIGS. 9B-9D, the cover member 62 includes an upper wrap portion 59 that wraps over an upper edge of the reinforcement member 58, as described below. The external side wall further includes a J-shaped clip member 75 secured to the vertical outer edges 72 of the cover member 62, and J-shaped clip members 77 secured to an inner edge of the upper wrap portion 59 of the cover member 62.

Figure 10:
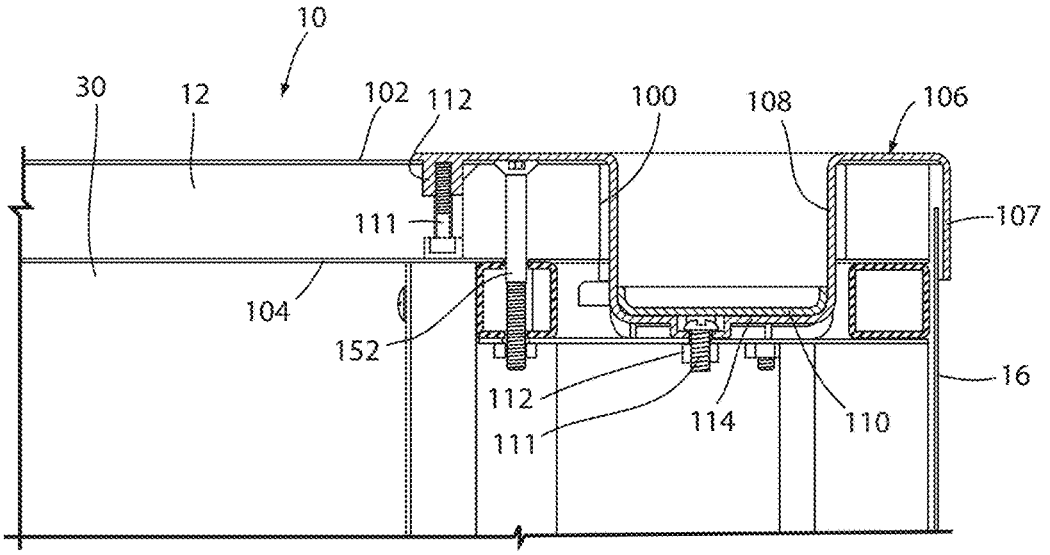
FIG. 10 is a cross-sectional side elevational view of a handle of the storage assembly taken along the line X-X, FIG. 1.

Each end portion 40 of the top wall 12 may also include a handle 92 configured so as to be easily gripped by a user to facilitate movement of the storage assembly 10 within a given workspace area. In the illustrated example, the handle 92 is provided as a triangularly-shaped relief 100 extending into the top wall 12 downward from a top surface 102 of the top wall 12. The relief 100 (FIG. 10) may extend completely through the top wall 12 from the top surface 102 through the bottom surface 104. In the illustrated example, the handle 92 is vertically aligned with the corresponding open space 21. The storage assembly 10 may also include a cap member 106 configured so as to cover a corresponding end portion 40 of the top wall 12. In the illustrated example, each cap member 106 is triangularly-shaped so as to correspond to the triangle shape of the corresponding end portion 40, and includes an upwardly-opening relief 108 that is co-aligned with the relief 100 of the corresponding end portion 40. The relief 108 is provided a triangularly-shaped cross-sectional configuration that corresponds to the triangle shape of the relief 100 of the end portion 40 of the top wall 12, however other cross-sectional configurations of the relief 100 and relief 108 may be utilized. Each cap member 106 may also include a bottom wall 110. It is noted that the cap member 106 is sized such that the cap member 106 extends completely through the relief 100 of the end portion 40 and into the open space 21 between the internal side wall 16 and the external side wall 18. The cap member 106 may be secured to the top wall 12 via a plurality of mechanical fasteners such as screws or bolts 111 threadably received within corresponding bosses 112 integrally molded with the cap member 106. A cover 114 may be positioned within the relief 108 so as to aesthetically cover at least some of the screws 111, and may be held within the relief 108 via a frictional engagement and/or an adhesive.

The storage assembly 10 may also include a plurality of caster assemblies 120 secured to and extending downward from the bottom wall 14 and positioned so as to movably support the storage assembly on a floor surface. In the illustrated example, each caster assembly 120 includes a caster mount 122 secured to an underside of the bottom wall 14 via a plurality of mechanical fasteners such as screws 124, a socket insert 126 press-fit within the corresponding caster mount 122, and a caster 128 pivotably received within the socket insert 126.

Figure 11:
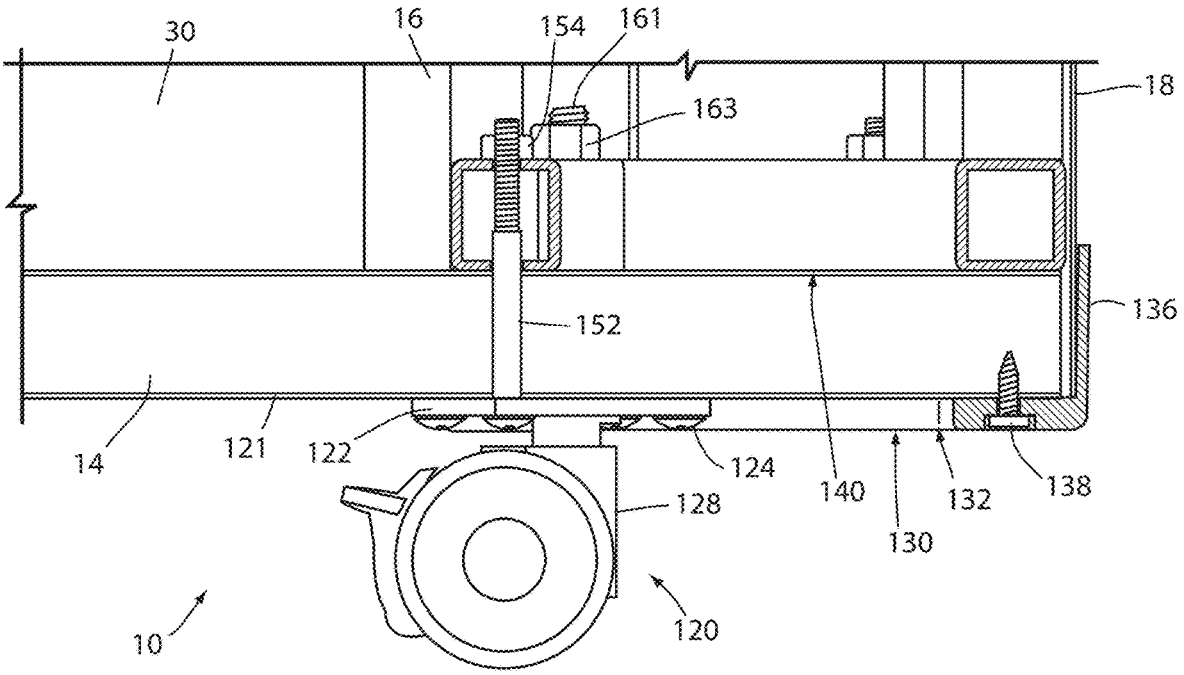
FIG. 11 is a cross-sectional side elevational view of the storage assembly taken along the line XI-XI, FIG. 1.

The storage assembly 10 may also include a pair of cover members 130 (FIGS. 1, 7 and 11) configured so as to wrap about the end surface 48 of the lower wall 14. In the illustrated example, each cover member 130 is provided with an L-shaped cross-sectional configuration including a horizontal bottom portion 132 and a vertical top portion 136. Each cover member 130 may be secured to the bottom surface 121 of the bottom wall 14 via a plurality of mechanical fasteners such as screws 138 extending through the bottom portion 132 and into the bottom wall 14.

The storage assembly 10 (FIG. 7) may further include a pair of frame assemblies 140 positioned within the corresponding open areas 21. The frame assemblies 140 may include an upper frame portion 142 positioned adjacent the top wall 12, a lower frame portion 144 positioned adjacent the bottom wall 14, and a plurality of vertical frame members 146 extending between the upper frame portion 142 and the lower frame portion 144, where the vertical frame members 146 are welded to the upper and lower frame portions 142, 144 or secured thereto in another suitable manner. In the illustrated example, the upper frame portion 142 and the lower frame portion 144 are each triangularly-shaped corresponding to the shape of the associated end portions 40, 44, and include a straight frame portion 147 and an angular frame portion 149 that cooperate to define an opening 150. The frame assembly comprises a metal, however, other suitable materials may also be utilized. In assembly, each frame assembly 140 is positioned between one of the end portions 40 of the top wall 12 and one of the end portions 44 of the bottom wall 14, and is secured to the top wall 12 and the bottom wall 14 via a plurality of mechanical fasteners such as bolts 152 and nuts 154 where the bolts 152 extend through the top and bottom walls 12, 14 and the upper and lower frame portions 142, 144. The external side wall 18 may be placed over the corresponding frame assembly 140 such that the external side wall 18 is also positioned between the end portion 40 of the top wall 12 and the end portion 44 of the bottom wall 14. It is noted that the cap member 106 includes a flange 107 that extends downwardly below an upper edge of the external side wall 18, while the top portion 136 of the cover member 30 extends upwardly from a bottom edge of the external side wall 18, such that the exterior side wall 18 is trapped between the flange 107 of the cap member 106 and the top wall 12 (FIG. 10) and between the top portion 136 of the cover member 130 and the bottom wall 14 when the cap member 106 and the cover member 130 are secured to the top wall 12 and the bottom wall 14, respectively. The J-shaped clip 75 extends over the outer edge 70 of the reinforcement member 58. The upper wrap portion 59 wraps or extends over the upper edge of the reinforcement member 58 and the angular frame portion 149 of the upper frame portion 142, and the J-shaped clip members 77 are received within elongated aperture 151 of the angular frame portion 149. The top wall 12 is then secured such that the top wall 12 abuts the upper wrap portion 59 thereby tightening the cover member 62 in the vertical direction.

Figure 12:
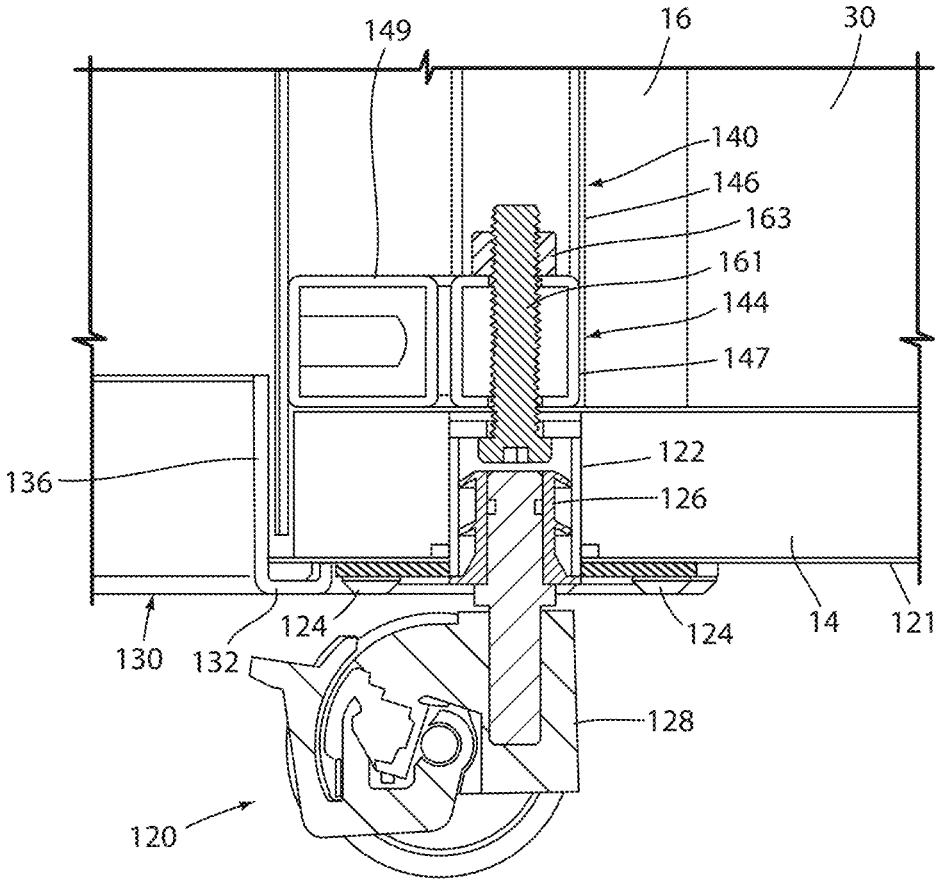
FIG. 12 is a cross-sectional side elevational view of the storage assembly taken along the line XII-XII, FIG. 1.

The frame assemblies 140 may also be configured to support the caster assemblies 120. Specifically, and as best illustrated in FIG. 12, the caster mount 122 may be secured directly to the lower frame portion 144 of the frame assembly 140 via a mechanical fastener such as a screw 161 and nut 163.

Figure 2:
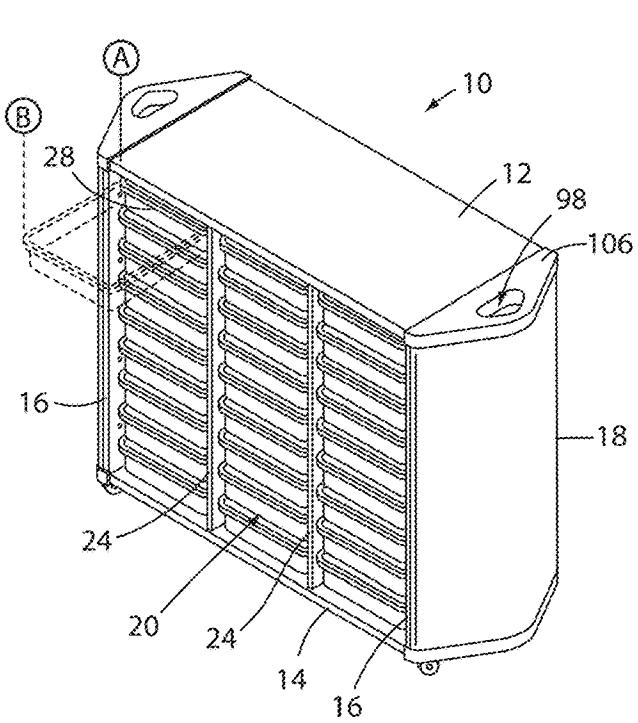
FIG. 2 is a perspective view of the storage assembly including a plurality of vertical partitions and drawers subdividing the interior storage space of the storage assembly.
Figure 5:
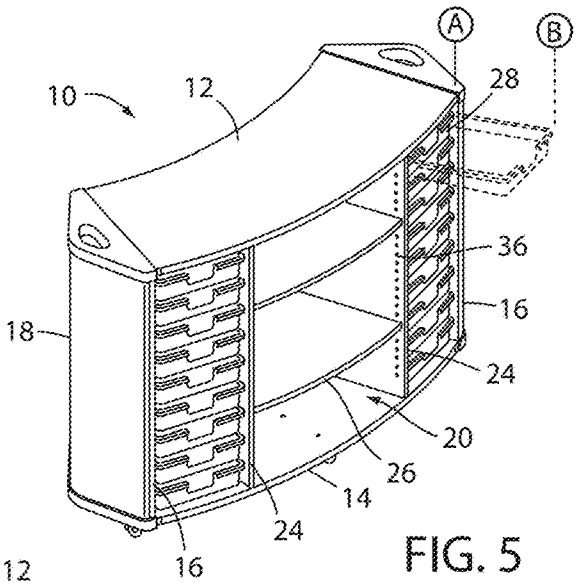
FIG. 5 is a perspective view of the partition assembly having an arcuately-shaped plan form where the internal storage space of the storage assembly is subdivided by vertical partitions, storage shelves and a plurality of drawers.
Figure 6:
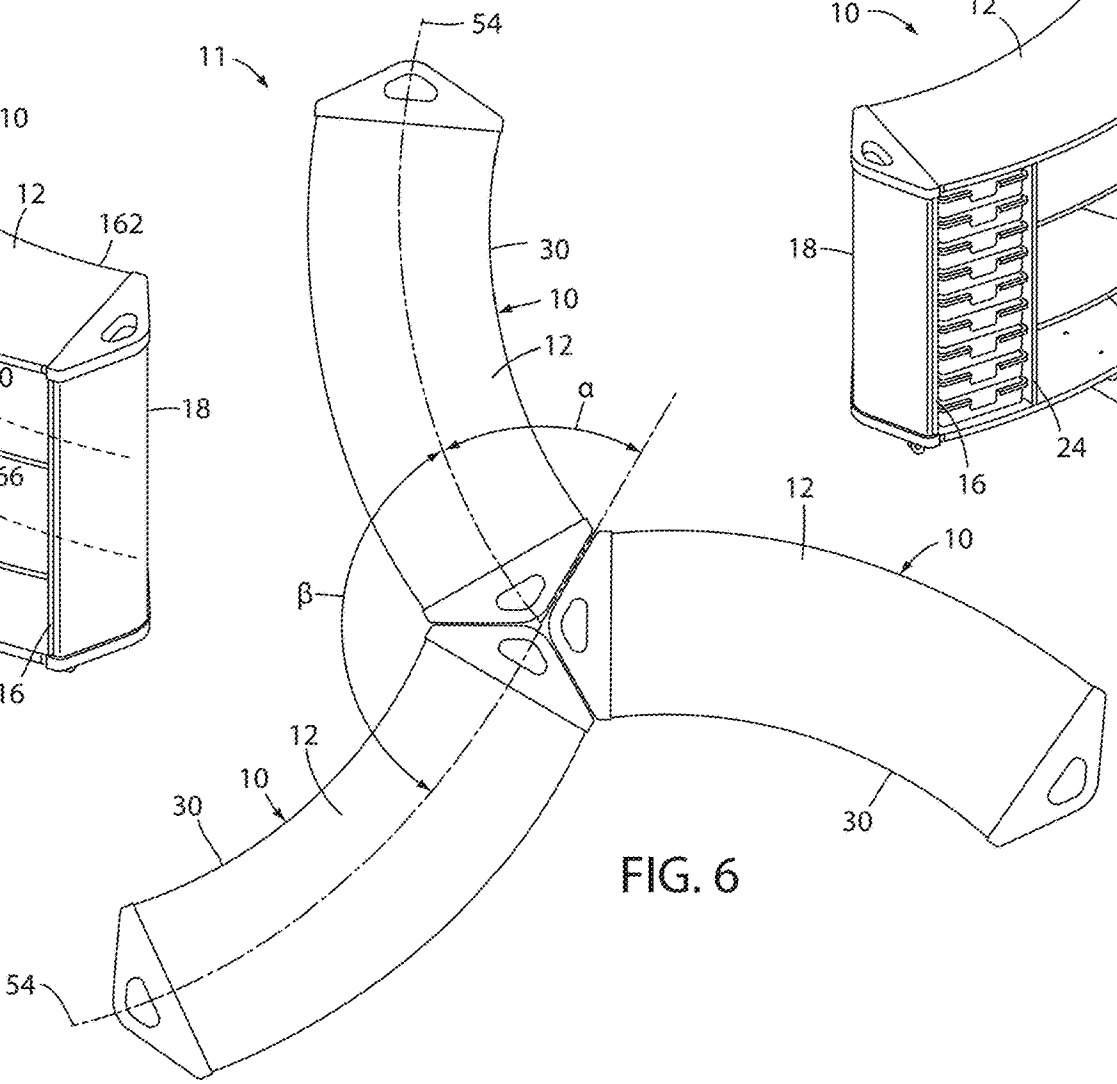
FIG. 6 is a top plan view of multiple storage assemblies closely interfit with one another in an end-to-end, non-linear orientation, and cooperating to provide the storage arrangement.
Figure 4:
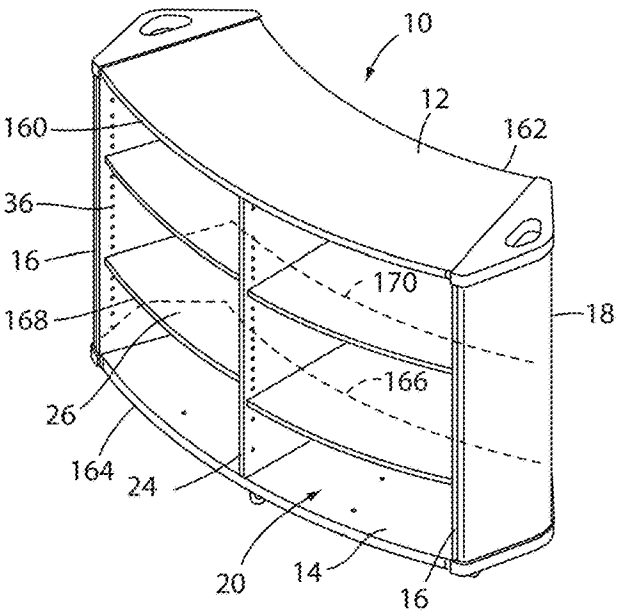
FIG. 4 is a perspective view of the storage assembly having a curved plan form configuration, where the internal storage space of the storage assembly is subdivided by a vertical partition and a plurality of shelves.

As noted above, the storage assembly 10 may be provided in various configurations. For example, the storage assembly 10 may be provided in a relatively straight configuration as shown in FIGS. 1-3, a curved configuration as shown in FIGS. 4-6, or other configurations. In the configuration as illustrated in FIGS. 1-3, the forward edge 160 and the rear edge 162 of the top wall 12, the forward edge 164 and the rearward edge 166 (FIG. 7) of the bottom wall 14, and the forward edge 168 and the rear edge 170 of the shelves 22 are each substantially straight along the length thereof, while the rear wall 30 is substantially planar. In the configuration as illustrated in FIGS. 4-6, the forward edge 160 and rear edge 162 of the top wall 12, the forward edge 164 and the rear edge 166 of the bottom wall 14 and the forward edge 168 and the rear edge 170 of each of the shelves 22 may be curved along the length thereof, while the rear wall 30 may be provided in the shape of a curved plane.

As discussed above, multiple storage assemblies 10 may be positioned adjacent one another and cooperate to form the storage arrangement 11. In the illustrated example, adjacent storage assemblies 10 may be positioned with respect to one another such that the straight edge portions 50 of the top wall 12, the straight edge portions 52 of the bottom wall, the portions 66 of the exterior side walls 18, the cap member 106, and/or the cover members 130 of the adjacent storage assemblies in a closely interfit manner as shown in FIGS. 3 and 6. Preferably, adjacent storage assemblies 10 are configured to closely interfit with one another such that the centerline of adjacent storage assemblies extend at an angle $\beta$ of greater than 90° from one another, and more preferably of greater than or equal to about 120° when the storage assemblies 10 are closely interfit with one another. The storage arrangement 11 may be formed utilizing storage assemblies of the straight configuration (FIGS. 1-3), of the curved configuration (FIGS. 4-6), other suitable configurations, or combinations thereof. While the top wall 12, the bottom wall 14, the exterior end wall 18, the cap member 106 and the cover member 130 are each illustrated as including a pair of straight portions or surfaces, it is noted that each of the elements may be configured to include one or more straight portions or surfaces configured such that adjacent storage assemblies 10 may closely interfit with one another in an offset of non-linear, end-to-end relationship so as to divide a given floor workspace area in the manner described above. The storage arrangement 11 may also include multiple storage assemblies 10 positioned proximate one another in a linearly offset, end-to-end, daisy chain-type relationship where at least one storage assembly 10 is positioned between two adjacent storage assemblies located at opposite ends thereof.

In the foregoing description, it will be readily appreciated by those skilled in the art that modifications may be made to the described embodiments without departing from the concepts disclosed herein. Such modifications are to be considered as included in the following claims, unless these claims by their language expressly state otherwise. While certain claims may depend from a certain claim or certain number of claims, each claim as presented herein may alternatively be combined with any other claim or claims. Components, parts, elements, assemblies, sub-assemblies and arrangements of any particular embodiment or configuration of the storage assemblies may be combined with the components, parts, elements, assemblies, sub-assemblies and arrangements of another embodiment, embodiments or configurations of the storage assemblies disclosed herein.

The invention claimed is:

1. A storage assembly, comprising:

a top wall;

a bottom wall;

a pair of end walls extending between the top and bottom walls and cooperating with the top and bottom walls to define an interior space; and at least one first end surface located at a first end of the storage assembly and configured to closely interfit with at least one end surface of a first pair of adjacent storage assemblies that are configured substantially similar to the storage assembly at a predefined first angular orientation such that a longitudinal axis of the storage assembly is angularly offset from a longitudinal axis of each of the storage assemblies of the first pair of adjacent storage assemblies when the at least one first end surface of the storage assembly is interfit with the at least one end surface of each of the adjacent storage assemblies of the first pair of adjacent storage assemblies; and wherein a centerline extends longitudinally between opposite ends of the top wall, and wherein the at least one first end surface includes a substantially straight edge portion that extends at an angle of at least about 60° from the centerline at a point of intersection of the substantially straight edge and the center line.

2. The storage assembly of claim 1, where the top wall includes the substantially straight edge portion.

3. The storage assembly of claim 1, wherein the substantially straight edge portion is one of a pair of substantially straight edge portions.

4. The storage assembly of claim 1, wherein the top wall includes a longitudinally-extending front edge and a longitudinally-extending rear edge each extending from the at least one first end surface, and wherein the front edge or rear edge is substantially straight along a length thereof.

5. A storage arrangement comprising three or more of the storage assemblies of claim 1, wherein the at least one first end surface of each of storage assembly of the three or more storage assemblies closely interfits with the at least one first end surface of two other storage assemblies of the three or more storage assembies.

6. A storage arrangement comprising three of the storage assemblies of claim 1, wherein a longitudinally-extending centerline of each of the storage assemblies extends at about 120° from a centerline of the first pair of adjacent storage assemblies when the at least one first end surface of each of the storage assemblies is closely interfit with the at least one end surface of the first pair of adjacent storage assemblies.

7. A storage assembly, comprising:

a top wall;

a bottom wall spaced from the top wall;

a pair of interior end walls extending between and abutting the top and bottom walls and cooperating with the top and bottom walls to define an interior storage space;

a pair of exterior end walls extending between the top and bottom walls and spaced outward of the interior end walls; and a pair of handle reliefs where one of the handle reliefs of the pair of handle reliefs extends into the top wall and is located at a position between one of the interior end walls and one of the exterior end walls and the other handle relief of the pair of handle reliefs extends into the top wall and is located at a position between the other interior end wall and the other exterior end wall, and wherein each handle is configured for grasping by a user to move the storage assembly across a floor surface.

8. The storage assembly of claim 7, wherein each of the handle reliefs includes an aperture extending between top and bottom surfaces of the top wall.

9. The storage assembly of claim 7, further comprising:

one or more wheels coupled to the bottom wall and configured to support the storage assembly above a floor surface.

10. The storage assembly of claim 7, further comprising:

a cap member covering at least a portion of an upper surface of the top wall and including a cap handle relief that substantially overlaps the handle relief.

11. The storage assembly of claim 7, further comprising:

at least one end surface configured to closely interfit with at least one end surface of an adjacent storage assembly that is substantially similar to the storage assembly at a predefined angular orientation such that a longitudinal axis of the storage assembly is angularly offset from a longitudinal axis of the adjacent storage assembly when the at least one end surface of the storage assembly is interfit with the at least one surface of the adjacent storage assembly.

12. A storage assembly, comprising:

a top wall;

a bottom wall spaced from the top wall;

a pair of interior end walls extending between the top and bottom walls and cooperating with the top and bottom walls to define an interior storage space;

an exterior wall extending between the top and bottom walls and positioned outside of the interior storage space, wherein the top wall, one of the interior end walls and the exterior wall cooperate to define an open area; and a frame assembly located within the open area and directly between the one of the interior end walls and the exterior wall and extending between the top and bottom walls, wherein the frame assembly supports the exterior wall and the top wall from the bottom wall.

13. The storage assembly of claim 12, wherein the frame assembly includes an upper frame portion positioned adjacent the top wall, a lower frame portion positioned adjacent the bottom wall, and one or more vertical frame members extending between the upper and lower frame portions.

14. The storage assembly of claim 12, wherein frame assembly has a substantially triangularly-shaped cross-sectional configuration.

15. The storage assembly of claim 12, wherein the frame assembly comprises metal.

16. The storage assembly of claim 12, further comprising:

a handle relief extending through the top wall at a position between one of the interior end walls and the exterior wall and configured for grasping by a user to move the storage assembly, and wherein the frame assembly is horizontally offset from the handle relief at a bottom surface of the top wall.

17. The storage assembly of claim 16, further comprising:

a cap member separate from the top wall and covering at least a portion of an upper surface of the top wall and including a cap handle relief that substantially overlaps the handle relief.

18. The storage assembly of claim 12, further comprising:

at least one end surface configured to closely interfit with at least one end surface of an adjacent storage assembly that is configured substantially similarly to the storage assembly at a predefined angular orientation such that a longitudinal axis of the storage assembly is angularly offset from a longitudinal axis of the adjacent storage assembly when the at least one end surface of the storage assembly is interfit with the at least one end surface of the adjacent storage assembly.

19. The storage assembly of claim 1, further comprising: at least one second end surface located at a second end of the storage assembly opposite the first end of the storage assembly and configured to closely interfit with at least one end surface of a second pair of adjacent storage assemblies that are substantially similar to the storage assembly at a predefined second angular orientation such that the longitudinal axis of the storage assembly is angularly offset from a longitudinal axis of each of the storage assemblies of the second pair of adjacent storage assemblies when the at least one second end surface of the storage assembly is interfit with the at least one end surface of each of the storage assemblies of the second pair of adjacent storage assemblies.

20. The storage assembly of claim 16, further comprising: a handle relief extending through the top wall at a position between one of the interior end walls and the exterior end wall, wherein the handle relief is horizontally offset from the interior storage space.

21. The storage assembly of claim 1, further comprising: at least one second end surface located at a second end of the storage assembly and configured to closely interfit with at least one end second surface of a second pair of adjacent storage assemblies that are substantially similar to the storage assembly at a predefined second angular orientation such that the longitudinal axis of the storage assembly is angularly offset from a longitudinal axis of each of the storage assemblies of the second pair of adjacent storage assemblies when the at least one second end surface of the storage assembly is interfit with the at least one end second surface of each of the adjacent storage assemblies of the second pair of adjacent storage assemblies.

22. The storage assembly of claim 1, further comprising: a plurality of wheels extending downwardly from the bottom wall and configured to support the storage assembly from a floor surface.

* * * * *